US005871066A

United States Patent [19]

Reece

[11] Patent Number: 5,871,066

[45] Date of Patent: Feb. 16, 1999

[54] RESCUE DEVICE

[76] Inventor: Norman Lee Reece, 940 Daphne, Broomfield, Colo. 80020

[21] Appl. No.: 128,677

[22] Filed: Jul. 23, 1998

[51] Int. Cl.[6] ..... A62B 1/20

[52] U.S. Cl. ..... 182/48; 182/70

[58] Field of Search ..... 182/48, 70

[56] References Cited

U.S. PATENT DOCUMENTS

| | | | |
|---|---|---|---|
| 4,099,595 | 7/1978 | Tracy | 182/48 |
| 4,531,611 | 7/1985 | Curiel | 182/44 |
| 4,681,186 | 7/1987 | Leisman et al. | 182/47 |
| 4,778,031 | 10/1988 | Curiel | 182/47 |
| 5,320,195 | 6/1994 | Reece | 182/48 |

*Primary Examiner*—Daniel P. Stodola
*Assistant Examiner*—Hugh B. Thompson
*Attorney, Agent, or Firm*—H. Kenneth Johnston, II

[57] ABSTRACT

A rescue device for escape from buildings having more than a single story where the device is portable and may be deployed quickly in the event of an emergency. The rescue device has a lightweight frame for attaching to a structure and a single concentric chute. The lightweight frame is made of a coated tubular aluminum and has a platform to sit on as an individual prepares to evacuate the building. The frame has an outside clamp arm attached to its outer portion to provide support to the rescue device when in use and the rescue device is secured to the building by a cinch strap which secures the outside clamp arm against the outside of a building and to the inside of the building by the inside clamp arm. The inside clamp arm which is hinged to the frame such that the inside clamp arm and outside clamp arm can be folded up for easy portability of the rescue device.

1 Claim, 5 Drawing Sheets

RESCUE DEVICE

BACKGROUND OF THE INVENTION

This invention relates to a rescue device for the safe and rapid evacuation of a building during an emergency situation. Fires and other emergency situations require immediate action to safely evacuate the building and minimize injury to individuals trying to escape from the building. The problems with respect to such disasters have been more serious in multi-story buildings as evacuation is much more difficult than that of a single story building. As it is well known, elevators in the multi-story buildings can not be used safely when a building is burning. Also, staircases become unusable due to smoke or lack of lighting due to electrical disruption from the disaster. Although a fireman's ladder may be able to reach some of the lower stories, there are numerous buildings that exceed the ability of any fireman's ladder to reach and can evacuate a small number of people per hour. The rescue chute allows many more individuals to be evacuated per hour compared to the ladder truck. An evacuation with a ladder truck requires a fireman to help get the individuals down the ladder and approximately 6 people in an hour make it safely. With the rescue chute one person every 17 seconds may be evacuated at a height of 100 feet. Additionally, a response from a fire rescue unit may not be sufficiently timely and the height at which an individual can safely jump is also substantially limited. There are numerous documented cases in which hundreds of lives were lost in multi-story buildings because the individuals have been unable to safely evacuate that building before the loss of their life. There are numerous methods that suggest various means of resolving this problem, however they leave much to be desired. In Curiel, U.S. Pat. No. 4,531,611, it is suggested to utilize a platform system in which the members are attached to an endless conveyor system to lower individual to safety during an emergency situation. This system has substantial drawbacks in that a separate structure must be built to house conveyor system with the platform members and is an expensive system. In Leisman, U.S. Pat. No. 4,681,186, a double chute system is utilized relying on the friction on an individual inside to slow his rate of decent. This system is not beneficial for use by small individuals or children. In Curiel, U.S. Pat. No. 4,778,031, it is suggested that a double chute that is tapered near the lower end. This is a problem as an individual utilizing the system from a substantial height may not be able to slow sufficiently to eliminate injury when reaching the bottom. In Tracy, U.S. Pat. No. 4,099,595, a chute is suggested with semi-cylindrical band throughout the chute that is expensive and is not easily transported.

In Reece et al., U.S. Pat. No. 5,320,195, the rescue chute lacks the ability to be easily stored and transported and cannot be operated by most individuals without substantial instruction. Also the within chute is a simple chute and a heat shield is optional and would be only required in extreme cases.

Most of the current aerial ladders and rescue platforms are limited in the height that they can reach and the number of people that can escape is relatively limited. These devices do not lend themselves to the rescue of disabled, injured or elderly individuals.

SUMMARY OF THE INVENTION

The present invention has met the need by providing a rescue device that is readily portable and allows individuals to utilize the device from any height and quickly with little effort in the deployment of the device. The rescue device of the present invention has a platform support frame which attaches to the window frame of a building utilizing a support arm and a vertical support which has a web belt attached to the support arm and secured at the vertical support. The chute is attached to the frame through which an individual descends to safety.

Because the rescue device is lightweight, any individual capable of reading instructions and lifting 22 pounds can use the rescue device, which also allows children and elderly persons to use the rescue device.

The rescue device can be deployed in minimum time; approximately 1–2 minutes and can be used for disabled, incapacitated and unconscious persons with the aid of at least one other healthy individual.

In the preferred embodiment, the rescue device is quickly attached to a window frame and the chute is dropped allowing the endangered individual to descend to safety.

It is an object of the present invention to provide and improved rescue device that will facilitate more efficient and safe egress of individuals from a building or other location.

It is another object of the invention to provide such a system wherein entry into and discharge from the rescue chute may be effective at various elevations.

It is further an object of the invention to provide such a rescue device that is economical to manufacture, durable and easy to use even those unskilled in the use of the equipment.

These and other objects of the invention will be more fully understood from the following description of the invention on reference to the illustrations appended hereto.

DETAILED DESCRIPTION OF THE PREFERRED EMBODIMENT

Figure 1:
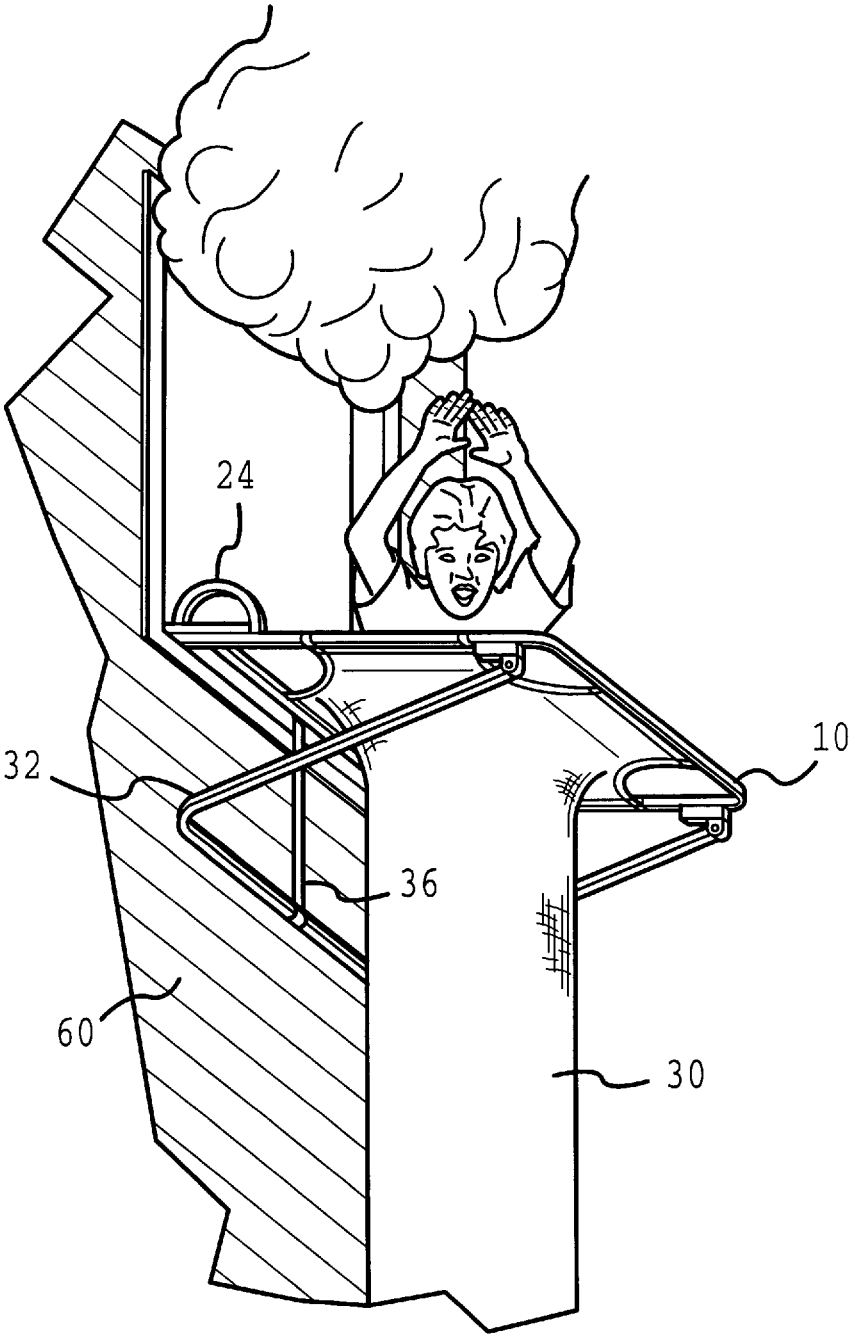
FIG. 1 is a perspective view of the rescue chute in use in an emergency situation.
Figure 2:
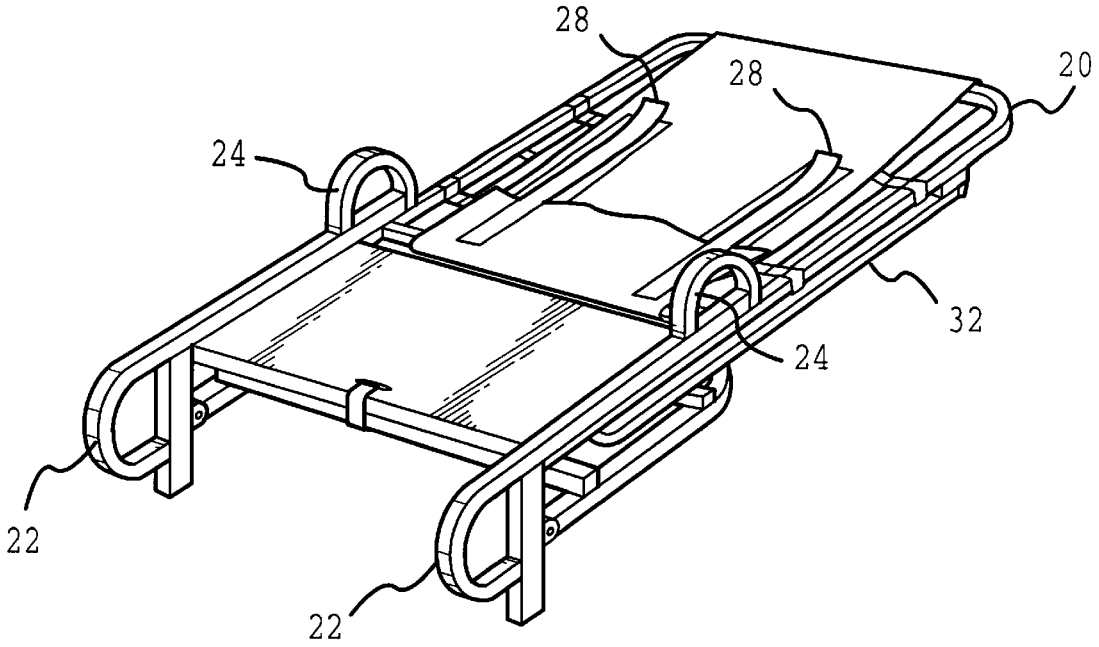
FIG. 2 is a perspective view of the rescue device in the portable mode.
Figure 3:
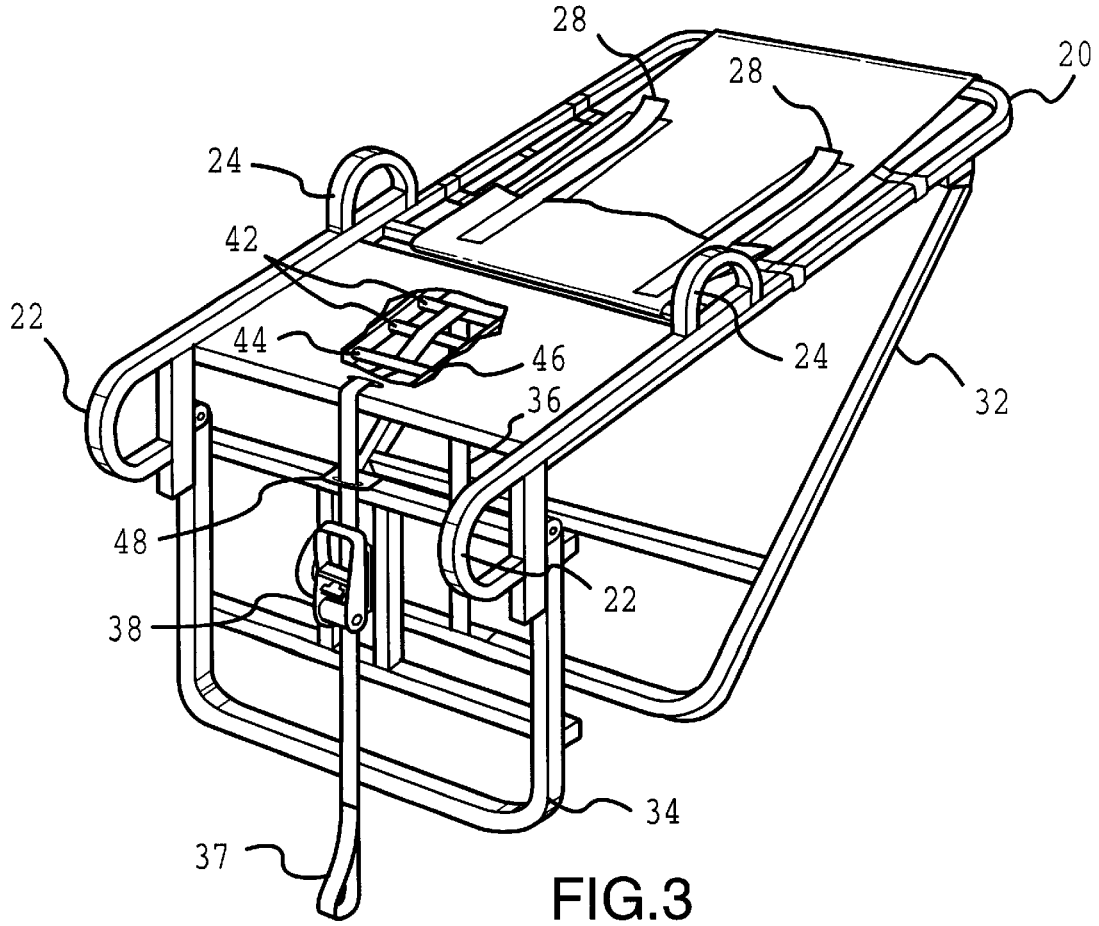
FIG. 3 is a perspective view of the rescue device in the partial erected mode.
Figure 4:
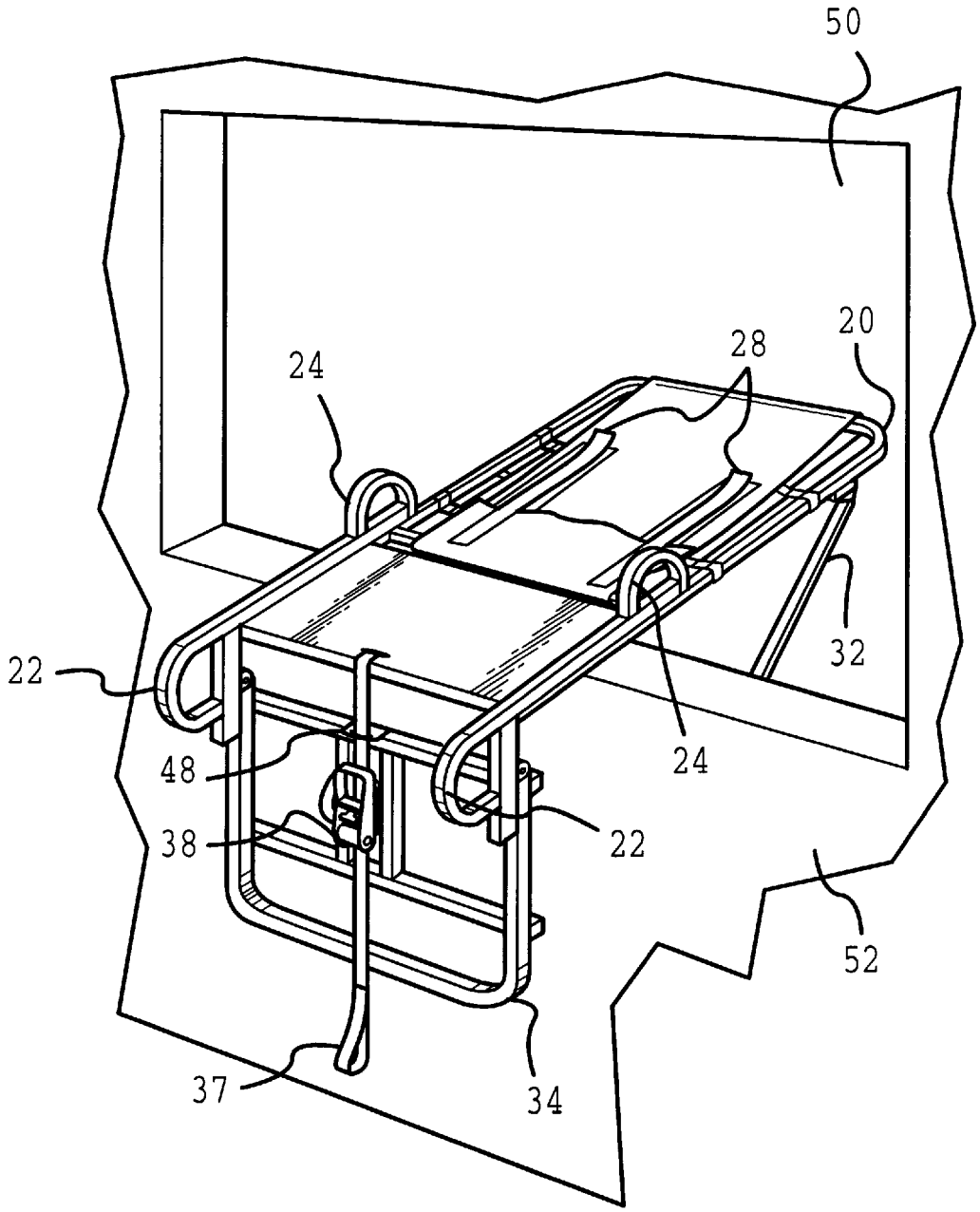
FIG.4 is a perspective view of the rescue device in erected mode.
Figure 5:
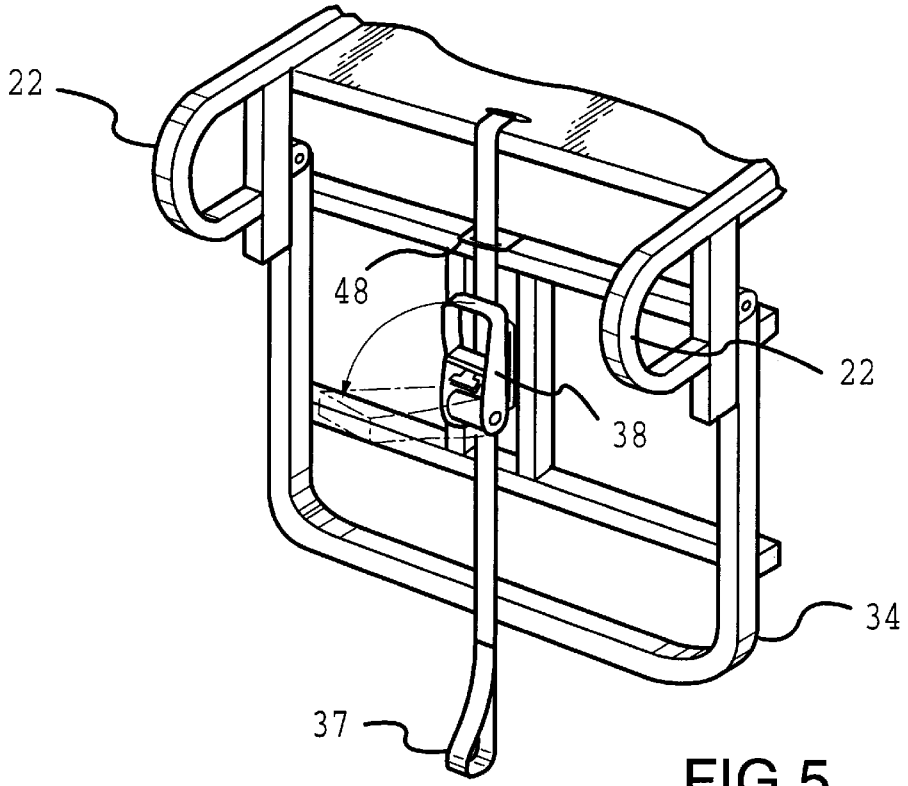
FIG. 5 is a partial view of the securing mechanism of the device.
Figure 6:
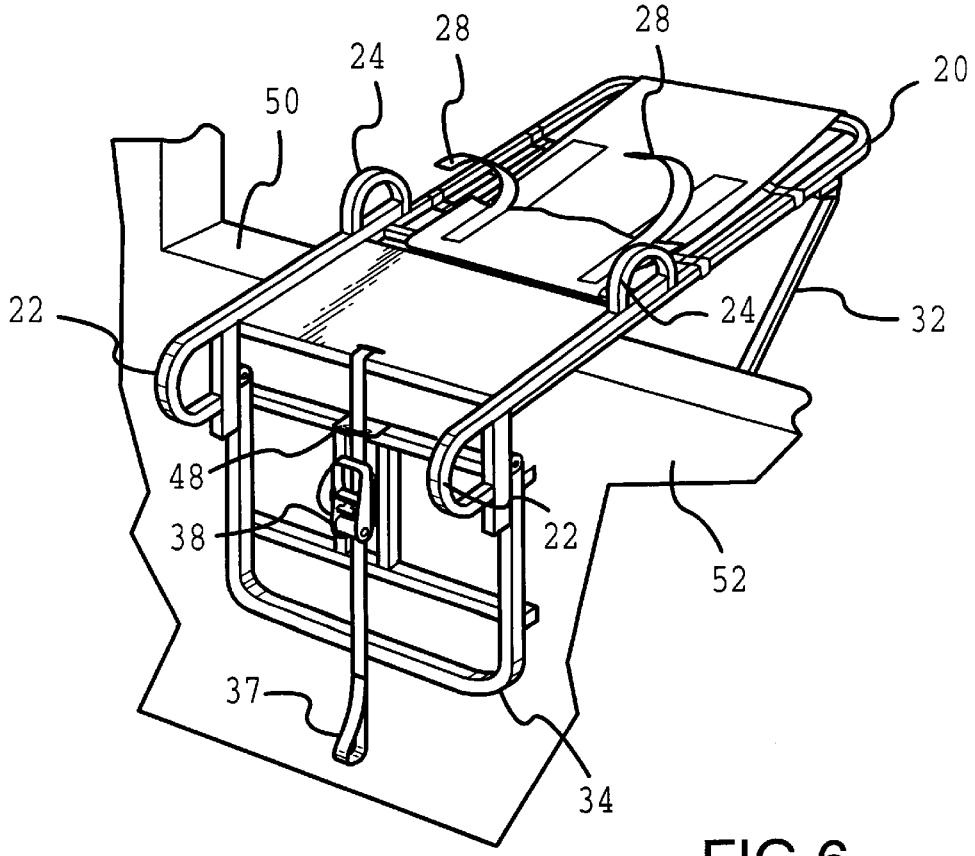
FIG. 6 is a perspective view of the rescue device being deployed.
Figure 7:
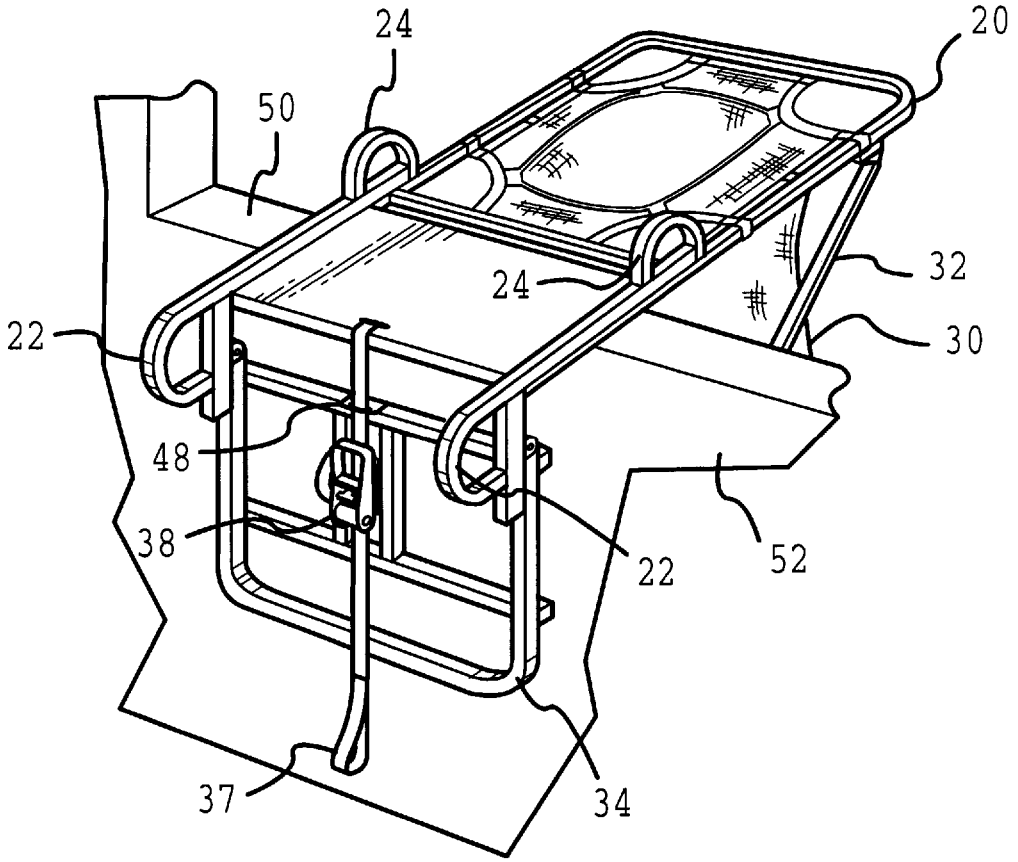
FIG. 7 is a perspective view of the rescue device fully deployed.

When needed the rescue device 10, which is made of a coated tubular aluminum, shown in FIG. 2, is removed from its emergency location and carried to a window by horizontal handles 22 and vertical handles 24. If the rescue device is to be carried by one individual, the individual would carry the rescue device 10 by one of the horizontal handles 22 and one of the vertical handles 24 for ease of carrying. Once the rescue device 10 is brought to a window, a securing strap (not shown) securing the outside clamp arm 32 and inside clamp arm 34 in the portable mode is removed allowing the inside clamp arm 34 to be opened to approximately right angles with frame 20. Rescue device 10 is pushed out a window 50 until inside clamp arm 34 is against the inside wall 52 of a structure as shown in FIG's 4,6, and 7. The outside clamp arm 32 is then secured against the structure 60 by pulling cinch strap 36 snug and tightening with ratchet 38 until outside clamp arm 32 and inside clamp arm 34 are secure against the structure 60 and wall 52 as shown in FIG. 5. Cinch strap 36 is attached to the outside clamp arm 32 at approximately the center of the extension of the outside clamp arm as shown in FIG. 1 and is threaded over rollers 42 and under an axle 46 adjacent to opening 44 and then down through guide 48 and is threaded through ratchet 38 as partially shown in FIG. 3 for securing the rescue device 10 to the structure 60. Cinch strap 36 has a loop handle 37 at its end nearest the ratchet 38 for ease in snugging the cinch strap 36 before use of the ratchet 38. Deployment straps 28 are then pulled releasing chute 30 as shown in FIG. 6 and having the rescue device 10 fully installed as shown in FIG. 7. The individual then pulls himself through the window 50 using vertical handles 24 and sits on deck 26 placing his feet into the chute 30 and descends to safety. The speed at which the individual descends is dependent on the individual and is controlled by the individual getting smaller in the chute 30 or stretching out slowing the descent.

It is understood that the certain variations in the invention may be made without departing from the scope thereof. Whereas particular embodiments of the invention have been described above for the purposes of illustration, it will be appreciated by those skilled in the art that numerous variations of the details may be made without departing from the invention as described in the appended claims.

What is claimed:

1. A portable rescue device for providing escape from multi-story buildings during emergency conditions consisting of:

a frame;

said frame having a first section and a second section;

said first section having a platform affixed thereon and said second section having an evacuation chute affixed thereto;

said evacuation chute affixed around an opening in said second section allowing persons to enter said evacuation chute through said second section;

said second section of said frame having an outside clamp hingedly affixed at an end thereof to one end of said second section and said first section of said frame having an inside clamp hingedly affixed at an end of said frame for securing said first section to a multi-story building;

said evacuation chute affixed to said second section of said frame such that when deployed said evacuation chute descends through said outside clamp;

said evacuation chute releaseably contained in its portable mode by a releasable sheath;

said inside clamp having an inside surface and an outside surface whereby said inside surface fits against an inside wall of a multi-story building and said outside surface having affixed thereon a cinch guide and a ratchet;

said ratchet affixed within the center of said outside surface of said inside clamp and capable of receiving and securing a cinch;

said platform affixed adjacent to said inside clamp for supporting an individual while preparing to utilize said rescue device;

said frame having a plurality of rollers and an axle beneath said platform capable of supporting said cinch;

said outside clamp having said cinch centeredly affixed at an end opposite of said hinged end of outside clamp capable of securing said outside clamp against a multi-story building; said cinch is threaded between said plurality of said rollers and said platform and under said axle and through an opening in said platform centered at an end of said platform and down through said cinch guide and said ratchet for securing secures said rescue device to a multi-story building allowing an individual to escape by releasing said releasable sheath with said evacuation chute extending such that an individual can descend safety during an emergency situation.

* * * * *